US009310084B2

(12) United States Patent
Chen

(10) Patent No.: US 9,310,084 B2
(45) Date of Patent: Apr. 12, 2016

(54) STOVE DEACTIVATION TIMER ASSEMBLY

(71) Applicant: Frank Chen, San Marino, CA (US)

(72) Inventor: Frank Chen, San Marino, CA (US)

( * ) Notice: Subject to any disclaimer, the term of this patent is extended or adjusted under 35 U.S.C. 154(b) by 98 days.

(21) Appl. No.: 14/227,753

(22) Filed: Mar. 27, 2014

(65) Prior Publication Data

US 2015/0276230 A1 Oct. 1, 2015

(51) Int. Cl.
*F24C 3/12* (2006.01)
*F23N 5/22* (2006.01)
*G04F 3/02* (2006.01)

(52) U.S. Cl.
CPC . *F24C 3/124* (2013.01); *F23N 5/22* (2013.01); *G04F 3/025* (2013.01); *Y10T 137/86397* (2015.04)

(58) Field of Classification Search
CPC ..... G04F 3/025; G04F 3/02; F24C 3/124; F23N 5/22; Y10T 137/86397
See application file for complete search history.

(56) References Cited

U.S. PATENT DOCUMENTS 2,502,220 A * 3/1950 Kaefer ..... F23N 5/22 200/39 R
2,810,435 A * 10/1957 Demi ..... F16K 31/48 137/624.11
3,595,273 A * 7/1971 Kolodziej ..... F16K 31/48 137/614.12
3,803,923 A * 4/1974 Hajny ..... F16K 31/48 137/624.12
3,820,405 A * 6/1974 Hong ..... F24C 3/124 137/624.12
4,756,336 A 7/1988 Amezcua
5,464,953 A 11/1995 Kim
6,354,172 B1 3/2002 Piacenza
6,733,276 B1 5/2004 Kopping
6,755,213 B1 6/2004 Lai
7,134,871 B2 11/2006 Chen et al.
7,816,818 B2 10/2010 Sellecchia
2003/0154970 A1 8/2003 Huang
2006/0234177 A1 10/2006 Yu et al.

* cited by examiner

*Primary Examiner* — Kevin Lee

(57) ABSTRACT

A timer assembly includes a knob operationally coupled to a stove. A shaft is operationally coupled to the knob. The shaft selectively engages a valve on the stove. The knob is retained on the stove. The shaft opens the valve when the knob is rotated to an on position. The shaft closes the valve when the knob is rotated to an off position. A timer is operationally coupled to the shaft. The timer urges the knob to the on position for a selected duration of time. A spring biasing member is operationally coupled to the housing. A strip is coupled between the shaft and the spring biasing member. The spring biasing member urges the knob to the off position. The spring biasing member moves the knob to the off position after the timer ceases urging the knob to the on position.

17 Claims, 3 Drawing Sheets

STOVE DEACTIVATION TIMER ASSEMBLY

BACKGROUND OF THE DISCLOSURE

Field of the Disclosure

The disclosure relates to timer devices and more particularly pertains to a new timer device which replaces a knob on a stove and automatically de-actuates the stove after a selected duration of time.

SUMMARY OF THE DISCLOSURE

An embodiment of the disclosure meets the needs presented above by generally comprising a knob operationally coupled to a stove. A shaft is operationally coupled to the knob. The shaft selectively engages a valve on the stove. The knob is retained on the stove. The shaft opens the valve when the knob is rotated to an on position. The shaft closes the valve when the knob is rotated to an off position. A timer is operationally coupled to the shaft. The timer urges the knob to the on position for a selected duration of time. A spring biasing member is operationally coupled to the housing. A strip is coupled between the shaft and the spring biasing member. The spring biasing member urges the knob to the off position. The spring biasing member moves the knob to the off position after the timer ceases urging the knob to the on position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
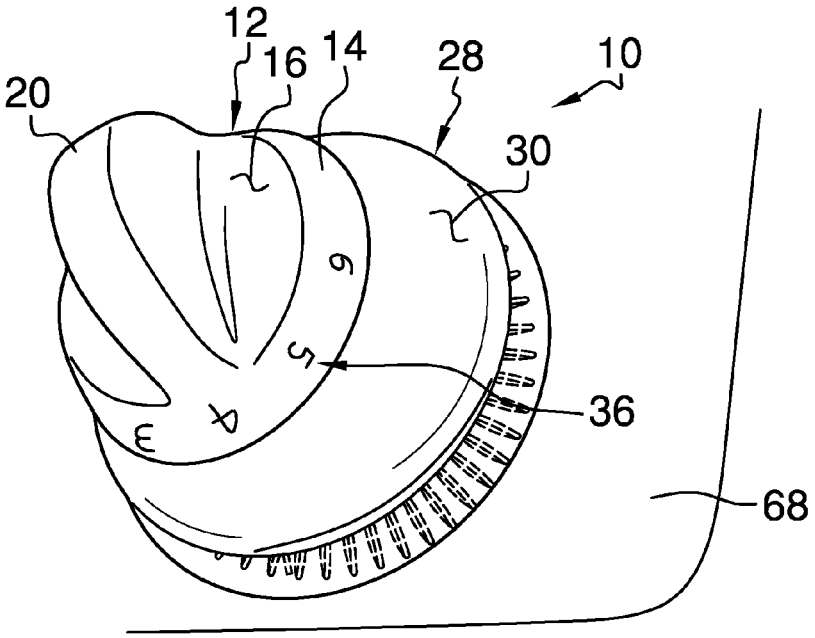
FIG. 1 is a perspective view of a timer assembly according to an embodiment of the disclosure.
Figure 2:
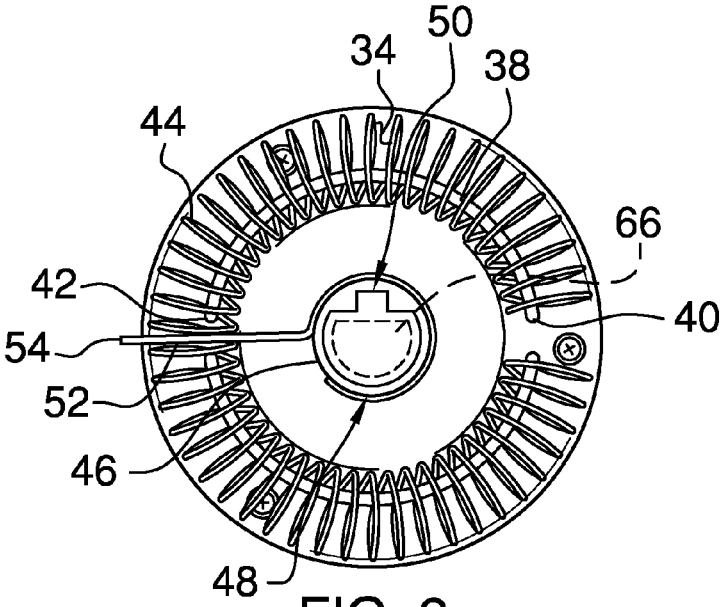
FIG. 2 is a bottom view of an embodiment of the disclosure.
Figure 3:
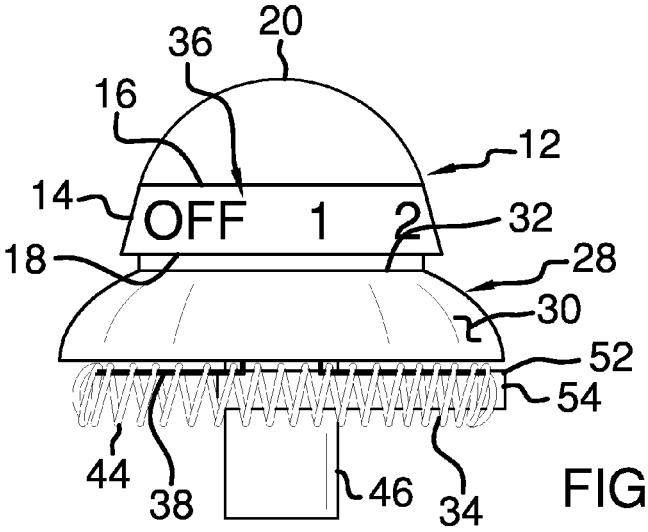
FIG. 3 is a right side view of an embodiment of the disclosure.
Figure 4:
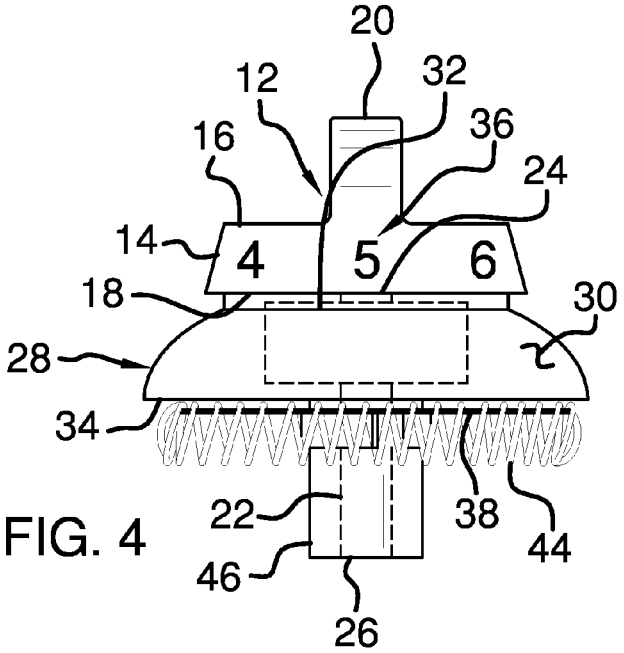
FIG. 4 is a front view of an embodiment of the disclosure.
Figure 5:
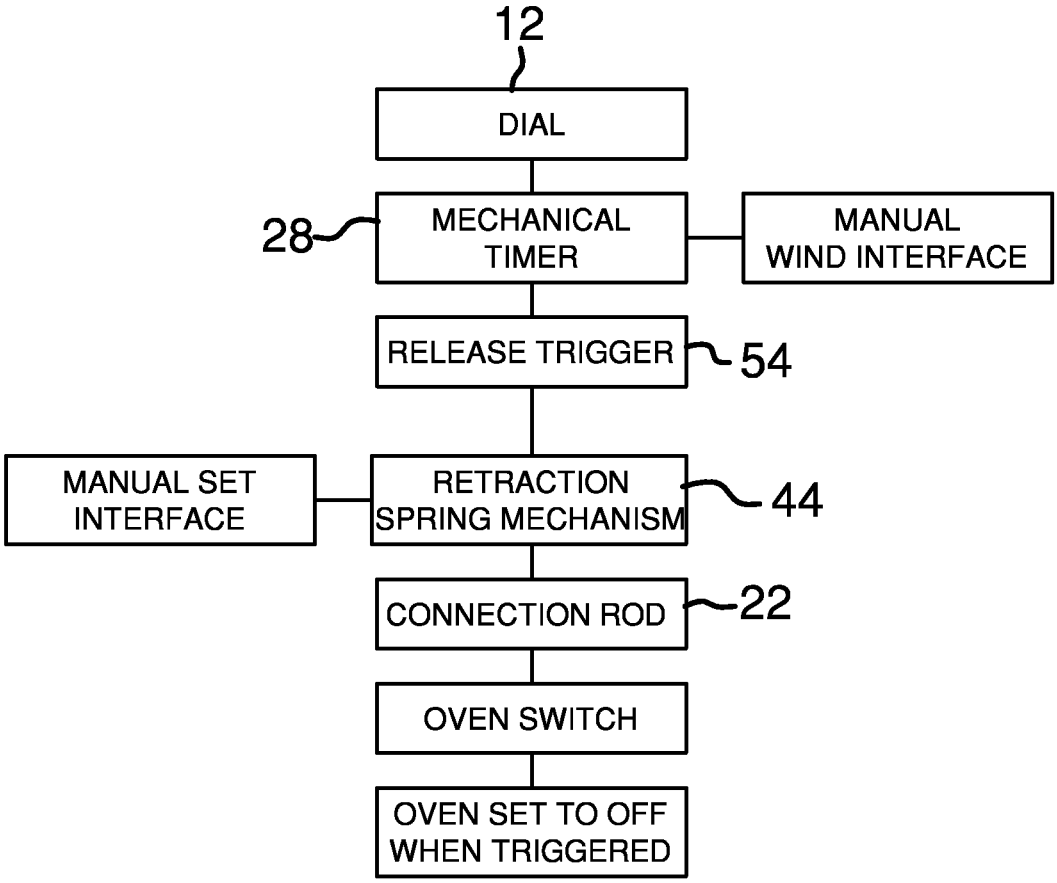
FIG. 5 is a schematic view of an embodiment of the disclosure.

With reference now to the drawings, and in particular to FIGS. 1 through 5 thereof, a new stove timer device embodying the principles and concepts of an embodiment of the disclosure and generally designated by the reference numeral 10 will be described.

As best illustrated in FIGS. 1 through 5, the timer assembly 10 generally comprises a knob 12 that has a outer edge 14 extending between a top surface 16 and a bottom surface 18 of the knob 12. The outer edge 14 of the knob 12 is curved so the knob 12 has a disk shape. Additionally, the knob 12 has a prominence 20 extending upwardly from the top surface 16 of the knob 12. The prominence 20 may be gripped.

A shaft 22 has a top end 24 and a bottom end 26. The top end 24 of the shaft 22 is coupled to the bottom surface 18 of the knob 12. The bottom end 26 of the shaft 22 is coupled to a valve 66 on a stove 68. The valve 66 may be a gas fuel valve of any conventional design. Moreover, the stove 68 may be a gas stove of any conventional design.

The knob 12 opens the valve 66 when the knob 12 is rotated in a counterclockwise direction. The knob 12 closes the valve 66 when the knob 12 is rotated in a clockwise direction. Alternatively, the shaft 22 may be coupled to a burner switch on the stove. In alternative, the stove 68 may be an electric stove of any conventional design.

A timer 28 is provided. An exterior surface 30 of the timer 28 extends between an upper surface 32 and a lower surface 34 of the timer 28. The exterior surface 30 of the timer 28 is curved so the timer 28 has a round shape. The upper surface 32 of the timer 28 has a diameter that is less than a diameter of the lower surface 34 of the timer 28. Finally, the timer 28 may be a mechanical timer 28 of any conventional design.

The shaft 22 extends downwardly through the upper surface 32 and the lower surface 34 of the timer 28. The timer 28 is positioned beneath the knob 12. The timer 28 is actuatable between a minimum duration of time and a maximum duration of time when the knob 12 is rotated in the counterclockwise direction. The minimum duration of time may be 3 minutes. The maximum duration of time may be 30 minutes.

Indicia 36 is printed on the outer edge 14 of the knob 12. The indicia 36 comprise the word "off" and the numbers "1" through "10". The indicia 36 extends around an entire circumference of the knob 12. Moreover, the numbers relate to incrementally increasing durations of time to which the timer 28 may be set. The word "off" is aligned with an indicator on the stove 68 when the knob 12 is in a full clockwise position. Each of the numbers is aligned with the indicator on the stove 68 when the knob 12 is in a selected degree of counterclockwise rotation.

A spring mount 38 is curved between a first end 40 and a second end 42 of the spring mount 38. The spring mount 38 is one of a pair of the spring mounts 38 each coupled to opposite sides of the lower surface 34 of the timer 28. The pair of spring mounts 38 forms a circular shape on the lower surface 34 of the timer 28. A spring biasing member 44 is operationally coupled to the pair of spring mounts 38. The spring biasing member 44 is formed into a circular shape.

A sleeve 46 is coupled around the shaft 22. The sleeve 46 is positioned proximate the bottom end 26 of the shaft 22. The sleeve 46 engages the valve 66 on the stove 68. The bottom end 26 of the shaft 22 has a valve well 48 extending upwardly therein. The valve well 48 insertably receives the valve 66 so the shaft 22 is rotatably coupled to the valve 66. A bounding surface of the valve well 48 defines a circle with a flattened side. A keyway 50 intersects the flattened side of the valve well 48.

A strip 52 is coupled to the sleeve 46. A free end 54 of the strip 52 extends laterally away from the sleeve 46. The free end 54 of the strip 52 extends through a middle of the spring biasing member 44. The strip 52 is centrally positioned in the spring biasing member 44 when the knob 12 is rotated fully clockwise. The strip 52 compresses the spring biasing member 44 when the knob 12 is rotated in the counterclockwise rotation. The spring biasing member 44 urges the strip 52 in the clockwise rotation.

The timer 28 urges the shaft 22 in the counterclockwise rotation when the knob 12 is rotated in the counterclockwise rotation. The timer 28 places the shaft 22 in a rotational equilibrium with respect to the spring biasing member 44. Additionally, the timer 28 retains the knob 12 in the selected degree of counterclockwise rotation. The timer 28 ceases urging the shaft 22 in the counterclockwise rotation after the selected duration of time has passed.

The spring biasing member 44 rotates the sleeve 46 in the clockwise rotation after the selected duration of time has passed. The valve on the stove 68 is closed for safety purposes after the timer 28 expires. The assembly may be one of a plurality of assemblies. Each of a plurality of existing knob 12*s* on the stove 68 may be replaced by an associated one of the plurality of assemblies.

In use, an existing knob 12 on the stove 68 is removed from the valve. The assembly is replaced on the valve. The knob 12 is rotated in the counterclockwise rotation to actuate the valve. Additionally, the knob 12 is rotated to select a duration of time between the minimum and the maximum duration of time. The assembly automatically turns the stove 68 off if the stove is left unattended. Moreover, the assembly is used to assist elderly or mentally incapacitated individuals in safely operating the stove 68.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A timer assembly for automatically deactivating a stove, said assembly comprising:

a knob operationally coupled to a stove;

a shaft operationally coupled to said knob, said shaft selectively engaging a valve on the stove wherein said knob is retained on the stove, said shaft opening said valve when said knob is rotated to an on position, said shaft closing said valve when said knob is rotated to an off position;

a timer operationally coupled to said shaft, said timer urging said knob to said on position for a selected duration of time;

a spring biasing member operationally coupled to said knob; and a strip coupled between said shaft and said spring biasing member such that said spring biasing member urges said knob to said off position, said spring biasing member moving said knob to said off position after said timer ceases urging said knob to said on position.

2. The assembly according to claim 1, wherein said knob having a outer edge extending between a top surface and a bottom surface of said knob, said outer edge of said knob being curved such that said knob has a disk shape, said knob having a prominence extending upwardly from said top surface of said knob such that said prominence may be gripped.

3. The assembly according to claim 1, wherein said shaft having a top end and a bottom end, said top end of said shaft being coupled to a bottom surface of said knob.

4. The assembly according to claim 1, wherein a bottom end of said shaft being coupled to the valve on the stove, said knob opening the valve when said knob is rotated in a counterclockwise direction, said knob closing the valve when said knob is rotated in a clockwise direction.

5. The assembly according to claim 1, wherein said timer having an exterior surface extending between an upper surface and a lower surface of said timer, said exterior surface of said timer being curved such that said timer has a round shape, said upper surface of said timer having a diameter being less than a diameter of said lower surface of said timer.

6. The assembly according to claim 1, wherein said shaft extending downwardly through an upper surface and a lower surface of said timer, said timer being positioned beneath said knob.

7. The assembly according to claim 1, wherein said timer being actuatable between a minimum duration of time and a maximum duration of time when said knob is rotated in a counterclockwise direction.

8. The assembly according to claim 1, wherein said timer being operationally coupled to said shaft such that said timer urges said shaft in a counterclockwise rotation when said timer is actuated between a minimum and a maximum duration of time.

9. The assembly according to claim 1, wherein a spring mount being curved between a first end and a second end of said spring mount.

10. The assembly according to claim 9, wherein said spring mount being one of a pair of spring mounts each coupled to opposite sides a lower surface of said timer, said pair of spring mounts forming a circular shape on said lower surface of said timer.

11. The assembly according to claim 1, wherein said spring biasing member being operationally coupled to a pair of spring mounts such that said spring biasing member is formed into a circular shape.

12. The assembly according to claim 1, wherein a sleeve coupled around said shaft, said sleeve being positioned proximate a bottom end of said shaft, said sleeve engaging the valve on the stove.

13. The assembly according to claim 1, wherein said strip being coupled to said sleeve such that a free end of said strip extends laterally away from said sleeve, said free end of said strip extending through a middle of said spring biasing member.

14. The assembly according to claim 1, wherein said strip compressing said spring biasing member when said knob is rotated in a counterclockwise rotation such said spring biasing member urges said strip in a clockwise rotation.

15. The assembly according to claim 1, wherein said timer urging said shaft in a counterclockwise rotation when said knob is rotated in said counterclockwise rotation, said timer placing said shaft in a rotational equilibrium with respect to said spring biasing member.

16. The assembly according to claim 12, wherein said spring biasing member rotating said sleeve in a clockwise rotation after said timer ceases urging said shaft in a counterclockwise rotation such that the valve on the stove is closed.

17. A timer assembly for automatically deactivating a stove after a selected duration of time, said assembly comprising:

a knob having a outer edge extending between a top surface and a bottom surface of said knob, said outer edge of said knob being curved such that said knob has a disk shape, said knob having a prominence extending upwardly from said top surface of said knob such that said prominence may be gripped;

a shaft having a top end and a bottom end, said top end of said shaft being coupled to said bottom surface of said knob, said bottom end of said shaft being coupled to a valve on the stove, said knob opening the valve when said knob is rotated in a counterclockwise direction, said knob closing the valve when said knob is rotated in a clockwise direction;

a timer having an exterior surface extending between an upper surface and a lower surface of said timer, said exterior surface of said timer being curved such that said timer has a round shape, said upper surface of said timer having a diameter being less than a diameter of said lower surface of said timer, said shaft extending downwardly through said upper surface and said lower surface of said timer, said timer being positioned beneath said knob, said timer being actuatable between a minimum duration of time and a maximum duration of time when said knob is rotated in said counterclockwise direction;

a spring mount being curved between a first end and a second end of said spring mount, said spring mount being one of a pair of spring mounts each coupled to opposite sides a lower surface of said timer, said pair of spring mounts forming a circular shape on said lower surface of said timer;

a spring biasing member operationally coupled to said pair of spring mounts such that said spring biasing member is formed into a circular shape;

a sleeve coupled around said shaft, said sleeve being positioned proximate said bottom end of said shaft, said sleeve engaging the valve on the stove;

a strip coupled to said sleeve such that a free end of said strip extends laterally away from said sleeve, said free end of said strip extending through a middle of said spring biasing member, said strip compressing said spring biasing member when said knob is rotated in said counterclockwise rotation such said spring biasing member urges said strip in said clockwise rotation; and said timer urging said shaft in said counterclockwise rotation when said knob is rotated in said counterclockwise rotation, said timer placing said shaft in a rotational equilibrium with respect to said spring biasing member, said spring biasing member rotating said sleeve in said clockwise rotation after said timer ceases urging said shaft in said counterclockwise rotation such that the valve on the stove is closed.

* * * * *